United States Patent [19]

Cook, Jr. et al.

[11] 4,061,550

[45] Dec. 6, 1977

[54] PROCESS FOR ELECTROLYSIS

[75] Inventors: Edward H. Cook, Jr., Lewiston; Alvin T. Emery, Youngstown, both of N.Y.

[73] Assignee: Hooker Chemicals & Plastics Corporation, Niagara Falls, N.Y.

[21] Appl. No.: 621,459

[22] Filed: Oct. 10, 1975

Related U.S. Application Data

[62] Division of Ser. No. 388,702, Aug. 15, 1973.

[51] Int. Cl.[2] ..... C25B 1/16; C25B 1/26

[52] U.S. Cl. ..... 204/98; 204/128

[58] Field of Search ..... 204/98, 128

[56] References Cited

U.S. PATENT DOCUMENTS

| | | | |
|---|---|---|---|
| 2,835,633 | 5/1958 | Kollsman | 204/98 |
| 2,967,807 | 1/1961 | Osborne et al. | 204/98 |
| 3,438,879 | 4/1969 | Kircher et al. | 204/98 |
| 3,496,077 | 2/1970 | Cooper | 204/98 |
| 3,694,281 | 9/1972 | Ledus | 156/77 |
| 3,773,634 | 11/1973 | Stacey et al. | 204/98 |

OTHER PUBLICATIONS

"XR Membranes," New Product Info., E.I. Dupont & Co., 10-1-69, pp. 1-4.

*Primary Examiner*—R. L. Andrews
*Attorney, Agent, or Firm*—Peter F. Casella; Herbert W. Mylius

[57] ABSTRACT

An electrolytic cell, suitable for use in electrolyzing alkali metal halide brines, which comprises a cell body having an anode compartment containing an anode, a cathode compartment containing a cathode and at least two buffer compartments between said anode and cathode compartments, said anode compartment and said buffer compartments being separated from each other by a barrier which is substantially impervious to fluids and gases, selected from a hydrolyzed copolymer of tetrafluoroethylene and a sulfonated perfluorovinyl ether having the formula:

$$FSO_2CF_2CF_2OCF(CF_3)CF_2OCF{=}CF_2$$

said copolymer having an equivalent weight of from about 900 to 1600, and a sulfostyrenated perfluorinated ethylene propylene polymer and said cathode compartment being separated from the next adjacent buffer compartment by a porous diaphragm.

13 Claims, 2 Drawing Figures

PROCESS FOR ELECTROLYSIS

This is a division, of application Ser. No. 388,702, filed Aug. 15, 1973.

This invention is related to an improved process and apparatus for the electrolysis of alkali metal halide brines and more particularly it relates to a process for the electrolysis of alkali halide brines in an electrolytic cell having at least four compartments, which cell utilizes a diaphragm or membrane which is substantially impervious to fluids and gases.

The production of numerous commercial chemicals by the electrolysis of various electrolyte solutions is well known. For example, chlorine and caustic soda are produced commercially by the electrolysis of sodium chloride brine solutions. Typically, this process is carried out in an electrolytic cell having an anode compartment and a cathode compartment, which compartments are separated by a fluid-permeable diaphragm, such as an asbestos diaphragm. The sodium hydroxide produced by this method is, however, relatively dilute and, because of the fluid permeable nature of the diaphragms used, it is further contaminated with various impurities, such as sodium chloride, sodium chlorate, iron and the like. It is, therefore, necessary to subject the sodium hydroxide product to various evaporation and purification steps in order to obtain a product which is suitable for many commercial uses. Moreover, with such electrolytic cells, there is an appreciable back migration of hydroxyl ions from the cathode compartment to the anode compartment which results in the production of hypochlorites which are oxidized to chlorates, with a consequent reduction in chlorine yield and further contamination of the sodium hydroxide. Additionally, depending upon the source of sodium chloride used in making up the brine electrolyte, brine purification systems must frequently be used to eliminate ions such as calcium, that may clog the fluid permeable diaphragms. Attempts have heretofore been made to overcome the aforesaid difficulties in the operation of such diaphragm cells by replacing the fluid permeable asbestos diaphragms with perselective ion exchange membranes. In theory, the use of such membranes which, for example, would permit the passage of only sodium ions from the anode compartment to the cathode compartment, would eliminate the problems of contamination of the sodium hydroxide liquor in the cathode compartment and would prevent the back migration of hydroxyl ions to the anode compartment. For this purpose, various resins, such as cation exchange resins of the "Amberlite" type, sulfonated copolymers of styrene and divinyl benzene, and the like, have been proposed. In practice, however, the permselective ion exhcnage membranes which have been used have generally been found not to be stable to the strong caustic and/or acidic solutions encountered in the cells at operating temperatures above 75° C so that they have had only a relatively short effective life. Additionally, as the concentration of caustic soda in the catholyte liquor is increased, e.g. above about 200 grams per liter, it has frequently been found that the ion selectivity and chemical compatibility of the membrane decreases, the voltage drop through the membrane becomes unacceptably high and the caustic efficiency of the electrolysis process decreases. Moreover, in many instances, the resins which have been used have been found to be relatively expensive so that the fabrication costs of the membrane has been unacceptably high. Attempts to overcome these drawbacks by utilizing one or more buffer compartments between the anode and cathode compartments of the cells have not solved the problem so that at the present time, there has been no appreciable utilization of membranes of this type for the commercial production of various chemicals, such as chlorine and caustic soda.

It is, therefore, an object of the present invention to provide an improved apparatus suitable for the electrolysis of alkali metal halide brines.

Another object of the present invention is to provide an improved process for electrolyzing aqueous solutions of ionizable chemical compounds, such as alkali metal halide brines, which is not subject to many of the disadvantages which have heretofore been encountered in the prior art processes.

A further object of the present invention is to provide an improved electrolysis apparatus which utilizes ion selective membranes and to provide a process for electrolyzing alkali metal halide brines using such apparatus.

These and other objects will become apparent to those skilled in the art from the description of the invention which follows.

In the drawing which is attached hereto and forms a part hereof,

Figure 1:
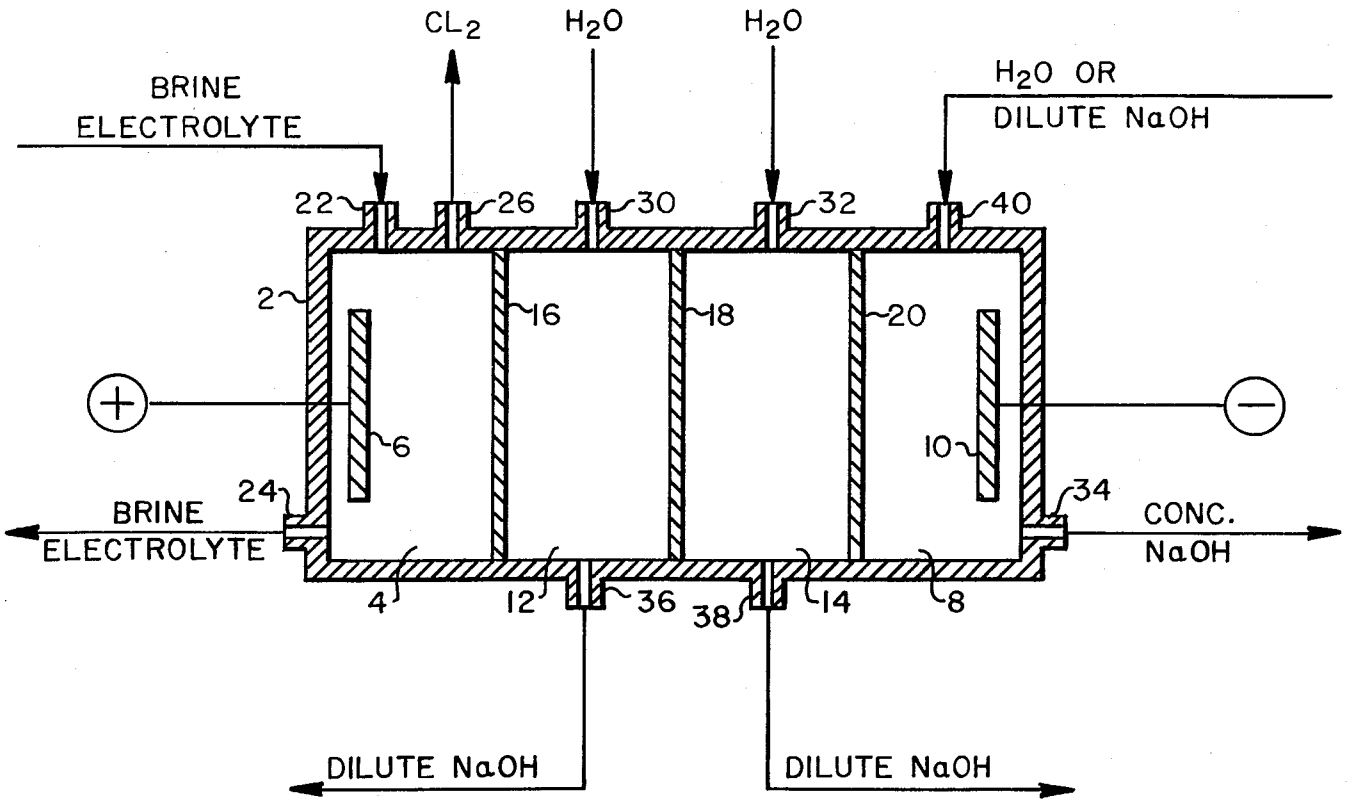
FIG. 1 is a schematic representation of a four compartment electrolytic cell of the present invention.

Pursuant to the above objects, the present invention includes an electrolytic cell, suitable for use in electrolyzing alkali metal halide brines, which comprises a cell body having an anode compartment containing an anode, a cathode compartment containing a cathode and at least two buffer compartments between said anode and cathode compartments, at least said anode compartment and the next adjacent buffer compartment being separated from each other by a barrier which is substantially impervious to fluids and gases selected from a hydrolyzed copolymer of a perfluorinated hydrocarbon and a sulfonated perfluorovinyl ether, and a sulfostyrenated perfluorinated ethylene proylene polymer and at least said cathode compartment and the next adjacent buffer compartment being separated from each other by a porous diaphragm.

In a preferred embodiment of the invention the permselective membranes are of a hydrolyzed copolymer of tetrafluoroethylene and a fluorosulfonated perfluorovinyl ether of the formula $FSO_2CF_2CF_2OCF(CF_3)CF_2OCF{=}CF_2$, which has an equivalent weight of about 900 to 1,600 and the membranes are mounted on networks of supporting materials such as polytetrafluoroethylene or asbestos filaments. The described preferred copolymers may be further modified to improve their activities, as by surface treating, modifying the sulfonic group or by other such mechanism. Such varieties of the polymers are included within the generic description given.

By the use of electrolytic cells of this type, it is found that highly concentrated alkali metal hydroxide solutions, which are significantly low in impurities, can be produced with maximum electrical operating efficiency.

More specifically, the electrolytic cell of the present invention comprises a cell body or container formed of materials which, as such, or when provided with a suitable coating, will be electrically nonconductive and withstand the temperatures at which the cell may be operated and will also be resistant to the materials being processed in the cell, such as chlorine, sodium hydroxide, hydrochloric acid, and the like. Exemplary of materials which may be used are various polymeric materials, such as high temperature polyvinyl chloride, hard rubber, chlorendic acid based polyester resins, and the like. Additionally, materials such as concrete, cement, and the like, may also be used. In the case of these latter materials, however, any interior exposed areas should have a coating which is resistant to hydrochloric acid, chlorine, caustic soda, or similar materials with which said surfaces will be in contact. Additionally, the cell body may be made of metal, such as steel, titanium, or the like, if the exposed surfaces are coated with a corrosion protective material and electrical insulation is provided where necessary.

The electrodes for the present electrolytic cell may be formed of any electrically conductive material which will resist the corrosive attack of the various cell reactants and products with which they may come in contact, such as alkali metal hydroxides, hydrochloric acid, and chlorine. Typically, the cathodes may be constructed of graphite, iron, steel, or the like, with steel being generally preferred. Similarly, the anodes may be formed of graphite or may be metallic anodes. Typically, where metallic anodes are used, these may be formed of a so-called "valve" metal, such as titanium, tantalum or niobium as well as alloys of these in which the valve metal constitutes at least about 90% of the alloy. The surface of the valve metal may be made active by means of a coating of one or more noble metals, noble metal oxides, or mixtures of such oxides, either alone or with oxides of the valve metal. The noble metals which may be used include ruthenium, rhodium, palladium, irridium, and platinum. Particularly preferred metal anodes are those formed of titanium and having a mixed titanium oxide and ruthenium oxide coating on the surface, as is described in U.S. Pat. No. 3,632,498. Additionally, the valve metal substrate may be clad on a more electrically conductive metal core, such as aluminum, steel, copper, or the like.

The cell body or container is formed into at least one set or unit of compartments made up of an anode compartment, containing the anode, a cathode compartment, containing the cathode, and at least two buffer compartments between the anode and cathode compartments. Typically, the electrolytic cell will contain a plurality of these sets, e.g., 20 to 30 or more, depending upon the size of the cell.

At least the anode compartment and the next adjacent buffer compartment are separated from each other by a barrier or membrane which is substantially impervious to fluids and gases and composed essentially of a hydrolyzed copolymer of a perfluorinated hydrocarbon and a fluorosulfonated perfluorovinyl ether. The perfluorinated hydrocarbon is preferably tetrafluoroethylene, although other perfluorinated and saturated and unsaturated hydrocarbons of 2 to 5 carbon atoms may also be utilized, of which the monoolefinic hydrocarbons are preferred, especially those of 2 to 4 carbon atoms and most especially those of 2 to 3 carbon atoms, e.g., tetrafluoroethylene, hexafluuoropropylene. The sulfonated perfluorovinyl ether which is most useful is that of the formula $FSO_2CF_2CF_2OCF(CF_3)CF_2OCF=CF_2$. Such a material, named as perfluoro[2-(2-fluorosulfonylethoxy)-propyl vinyl ether], referred to henceforth as PSEPVE, may be modified to equivalent monomers, as by modifying the internal perfluorosulfonylethoxy component to the corresponding propoxy component and by altering the propyl to ethyl or butyl, plus rearranging positions of substitution of the sulfonyl thereon and utilizing isomers of the perfluoro lower alkyl groups, respectively. However, it is most preferred to employ PSEPVE.

The method of manufacture of the hydrolyzed copolymer is described in Example XVII of U.S. Pat. No. 3,282,875 and an alternative method is mentioned in Canadian Pat. No. 849,670, which also discloses the use of the finished membrane in fuel cells, characterized therein as electrochemical cells. The disclosures of such patents are hereby incorporated herein by reference. In short, the copolymer may be made by reacting PSEPVE or equivalent with tetrafluoroethylene or equivalent in desired proportions in water at elevated temperature and pressure for over an hour, after which time the mix is cooled. It separates into a lower perfluoroether layer and an upper layer of aqueous medium with dispersed desired polymer. The molecular weight is indeterminate but the equivalent weight is about 900 to 1,600 preferably 1,100 to 1,400 and the percentage of PSEPVE or corresponding compound is about 10 to 30%, preferably 15 to 20% and most preferably about 17%. The unhydrolyzed copolymer may be compression molded at high temperature and pressure to produce sheets or membranes, which may vary in thickness from 0.02 to 0.5 mm. These are then further treated to hydrolyze pendant $—SO_2F$ groups to $—SO_3H$ groups, as by treating with 10% sulfuric acid ;or by the methods of the patents previously mentioned. The presence of the $—SO_3H$ groups may be verified by titration, as described in the Canadian patent. Additional details of various processing steps are described in Canadian Pat. No. 752,427 and U.S. Pat. No. 3,041,317, also hereby incorporated by reference.

Because it has been found that some expansion accompanies hydrolysis of the copolymer it is preferred to position the copolymer membrane after hydrolysis onto a frame or other support which will hold it in place in the electrolytic cell. Then it may be clamped or cemented in place and will be true, without sags. The membrane is preferably joined to the backing tetrafluoroethylene or other suitable filaments prior to hydrolysis, when it is still thermoplastic; and the film of copolymer covers each filament, penetrating into the spaces between them and even around behind them, thinning the films slightly in the process, where they cover the filaments.

The membrane described is far superior in the present processes to all other previously suggested membrane materials. It is more stable at elevated temperatures, e.g., above 75° C. It lasts for much longer time periods in the medium of the electrolyte and the caustic product and does not become brittle when subjected to chlorine at high cell temperatures. Considering the savings in time and fabrication costs, the present membranes are more economical. The voltage drop through the membranes is acceptable and does not become inordinately high, as it does with many other membrane materials, when the caustic concentration in the cathode compartment increases to above about 200 g./l of caustic. The selectivity of the membrane and its compatibility with the electrolyte does not decrease detrimentally as the hydroxyl concentration in the catholyte liquor increases, as has been noted with other membrane materials. Furthermore, the caustic efficiency of the electrolysis does not diminish as significantly as it does with other membranes when the hydroxyl ion concentration in the catholyte increases. Thus, these differences in the present process make it practicable, whereas previously described processes have not attained commercial acceptance. While the more preferred copolymers are those having equivalent weights of 900 to 1,600, with 1,100 to 1,400 being most preferred, some useful resinous membranes produced by the present method may be of equivalent weights from 500 to 4,000. The medium equivalent weight polymers are preferred because they are of satisfactory strength and stability, enable better selective ion exchange to take place and are of lower internal resistances, all of which are important to the present electrochemical cell.

Improved versions of the above-described copolymers may be made by chemical treatment of surfaces thereof, as by treatments to modify the $FSO_3H$ group thereon. For example, the sulfonic group may be altered or may be replaced in part with other moieties. Such changes may be made in the manufacturing process r after production of the membrane. When effected as a subsequent surface treatment of a membrane the depth of treatment will usually be from 0.001 to 0.01 mm. Caustic efficiencies of the invented processes, using such modified versions of the present improved membranes, can increase about 3 to 20%, often about 5 to 15%.

In addition to the copolymers previously discussed, including modifications thereof, it has been found that another type of membrane material is also superior to prior art films for applications in the present processes. Although it appears that tetrafluoroethylene (TFE) polymers which are sequentially styrenated and sulfonated are not useful for making satisfactory cation-active permselective membranes for use in the present electrolytic processes it has been established that perfluorinated ethylene propylene polymer (FEP) which is styrenated and sulfonated makes a useful membrane. Whereas useful lives of as much as three years or more (that of the preferred copolymers) may not be obtained the sulfostyrenated FEP's are surprisingly resistant to hardening and otherwise failing in use under the present process conditions.

To manufacture the sulfostyrenated FEP membranes a standard FEP, such as manufactured by E. I. DuPont de Nemours & Co. Inc., is styrenated and the styrenated polymer is then sulfonated. A solution of styrene in methylene chloride or benzene at a suitable concentration in the range of about 10 to 20% is prepared and a sheet of FEP polymer having a thickness of about 0.02 to 0.5 mm., preferably 0.05 to 0.15 mm., is dipped into the solution. After removal it is subjected to radiation treatment, using a cobalt$^{60}$ radiation source. The rate of application may be in the range of about 8,000 rads/hr. and a total radiation application is about 0.9 megarads. After rinsing with water the phenyl rings of the styrene portion of the polymer are monosulfonated, preferably in the para position, by treatment with chlorosulfonic acid, fuming sulfuric acid or $SO_3$. Preferably, chlorosulfonic acid in chloroform is utilized and the sulfonation is completed in about ½ hour.

Examples of useful membranes made by the described process are products of RAI Research Corporation, Hauppauge, New York, identified as 18ST12S and 16ST13S, the former being 18% styrenated and having ⅝ of the phenyl groups monosulfonated and the latter being 16% styrenated and having 13/16 of the phenyl groups monosulfonated. To obtain 18% styrenation a solution of 17-½% of styrene in methylene chloride is utilized and to obtain the 16% styrenation a solution of 16% of styrene in methylene chloride is employed.

The products resulting compare favorably with the preferred copolymers previously described, giving voltage drops of about 0.2 volt each in the present cells at a current density of 2 amperes/sq. in., the same as is obtained from the copolymer.

Desirably, these membranes are utilized in the form of a thin film, either as such, or deposited on an inert support or substrate, such as a cloth woven of polytetrafluoroethylene, glass fibers or the like. The thickness of such a supported membrane can be varied considerably, thicknesses of from about 3 to 15 mills being typical. These membranes may be fabricated into any desired shape, depending upon the configuration of the cell in which they are used. As has been noted, the membrane copolymer is initially obtained in a non-acid form, i.e., in the form of the sulfonyl fluoride. In this non-acid form, it is relatively soft and plyable and can be seam or butt welded to form welds which are as strong as the membrane material itself. Accordingly, it is preferred that the membrane material be shaped and formed in this non-acid state.

Once the membrane has been shaped or formed into the desired configuration, it is then conditioned for use by hydrolyzing the sulfonyl fluoride groups to free sulfonic acid or alkali metal sulfonate groups, for example by boiling in water or alkaline solution, such as caustic solution. This conditioning process may be carried out either before the membrane is placed in the cell or within the cell with the membrane in place. Typically, when the membrane is boiled in water for about 16 hours, the material undergoes swelling of about 28%, about 9% in each direction. Upon exposure to brine, during operation, the swelling is reduced to about 22%, resulting in a net tightening of the membrane during use.

In some instances, it has been found that it may be desirable to use a "sandwich" of two or more of these membranes, rather than only a single membrane. When such a sandwich is used in a chlor-alkali cell, it has been found that in some instances there is an increase in the caustic efficiency of the cell, particularly when operating at catholyte liquor caustic concentrations in excess of about 200 grams per liter. With the electrolytic cells of the present invention which have two or more buffer compartments between the anode and cathode compartment, however, this increase in caustic efficiency may not be sufficiently great as to offset the increased material cost of using such a membrane sandwich. Accordingly, although the use of such a sandwich is possible in the present cell, it may not always be preferred.

As has been noted hereinabove, the cation exchange membranes which have been described are used as the barrier between at least the anode compartment and the next adjacent buffer compartment. Additionally, a porous diaphragm or barrier is utilized between at least the cathode compartment and the next adjacent buffer compartment. It has been found that such a porous membrane will allow fluid flow from the buffer compartment to the cathode compartment, thus maintaining a caustic concentration gradient between these two compartments which results in higher caustic current efficiency.

These porous barriers or diaphragms may be formed of any suitable material. Typical of materials which may be used are deposited or woven asbestos, asbestos paper or cloth, woven synthetic cloths such as polytetrafluoroethylene or polypropylene, porous polymeric fibers such as Zitex, porous cationic exchange membranes, such as a porous form of the cationic exchange membrane as has been described heretofore, asbestos, coated or impregnated with a cationic exchange resin, such as the perfluorosulfonated material which has been described, asbestos coated or impregnated with other easily polymerizable materials, such as vinyl benzene, sulfonated vinyl benzene, or the like.

As has been previously noted, these porous barriers or diaphragms are used in conjunction with the cationic exchange membranes only between the cathode compartment and the next adjaent buffer compartment and between those buffer compartments which are closest to the cathode compartment. Moreover, the number of such porous diaphragms used should not exceed the number of the cation exchange membranes. Thus, for example, in a six compartment cell, i.e. a cell having an anode compartment, a cathode compartment and four buffer compartments between the anode and cathode compartments, there will be a total of five barriers separating the six compartments. Of these at least three will be the cation exchange membrane, which three are those which are closest to the anode compartment, and no more than two will be of a porous diaphragm, these two being those which are closest to the cathode compartment.

The anode compartment of each set or unit of compartments is formed with an inlet for introducing a liquid electrolyte into the compartment, such as an aqueous alkali metal halide brine and an outlet for gaseous reaction products, such as chlorine. The cathode compartment of each set or unit is formed with an outlet for liquid reaction products, such as aqueous solutions of alkali metal hydroxide, and also an outlet for gaseous byproducts, such as hydrogen. If desired, the cathode compartment may also be formed with an inlet for a liquid electrolyte, such as water, dilute alkali metal hydroxide solutions, or the like. Additionally, each of the buffer compartments between the anode and cathode compartments is formed with an inlet for liquid electrolytes, such as water and, if desired may also have an outlet for liquid reaction products, such as dilute alkali metal hydroxide solutions. Preferably, the inlets for liquid materials and the outlets for gaseous products in each of the compartments are located in the upper portion of the compartment while the outlets for liquid materials are positioned in the lower portion of the compartments, although other locations may also be used.

These repeating sets or units of anode, buffer, and cathode compartments may be formed into the total electrolytic cell of the present invention in any convenient manner. Thus, in a preferred embodiment, the cell is of the so-called "filter press" type. In this embodiment, the anodes, cathodes, and membranes or diaphragms are mounted in suitable mounting or frame members which are provided with suitable sealing gaskets and are formed so as to provide the desired spacing between the elements to from the anode, cathode and buffer compartments. These frame members are provided with the desired inlets and outlets, as have been described and are secured together by tie rods, bolts, or other suitable means as is known in the art. Typical of such a filter press configuration is that shown in U.S. Pat. No. 2,282,058.

Alternatively, the cell body may be in the form of a box of a suitable material of construction in which anode, cathode and membrane or diaphragm members are mounted to form the various compartments, such as that shown in U.S. Pat. No. 3,324,023. Additionally, the cell may be of the "conventional" chlor-alkali type having interleaved anodes and cathodes, wherein the deposited asbestos diaphragm is replaced with the various membranes and diaphragms, as have been described, to form the desired buffer compartments. Typical of such a cell structure is that shown in U.S. Pat. No. 3,458,411.

It is to be appreciated that the above are merely exemplary of the various cell configurations which may be used. In all of these, of course, suitable materials of construction will be used, as have been described hereinabove. Additionally, it is further to be appreciated that the particular configuration used in each instance will depend upon the various specific requirements for that particular cell.

Referring now to FIG. 1, this is a schematic representation of a four compartment cell, in which the cell is provided with two buffer compartments between the anode and cathode compartments. As is shown in this Figure, the cell body (2) is formed into an anode compartment (4) and a cathode compartment (8), which compartments are separated by two intermediate or buffer compartments (12) and (14). An anode (6) and a cathode (10) are positioned in the anode compartment (4) and cathode compartment (8), respectively. A series of barriers or membranes (16), (18) and (20) form the buffer compartments (12) and (14) and separate them from the anode compartment and the cathode compartment. Two of these membranes (16) and (18) are formed of a film of a fluorinated copolymer having pendant sulfonic acid groups, as has been described hereinabove and the membrane (20), which is adjacent the cathode compartment (8), is of a porous diaphragm, such as an asbestos diaphragm.

An inlet (22) and an outlet (24) are provided in the anode compartment for the introduction and removal of the electrolyte, such as a sodium chloride brine. Additionally, an outlet (26) is also provided in the anode compartment for the removal of gaseous decomposition products, such as chlorine. The buffer compartments (12) and (14) are each provided with inlets (30) and (32) respectively, and outlets (36) and (38), respectively. Where the cell is utilized for the electrolysis of a sodium chlorine brine, typically water will be introduced into the inlets (30) and (32) and a dilute solution of caustic soda will be removed from the outlets (36) and (38). Additionally, an inlet (40) and an outlet (34) are provided in the cathode compartment (8). Where a sodium chloride brine is being electrolyzed, a concentrated solution of caustic soda of high purity will be recovered from the outlet (34) and water or a dilute caustic soda solution may be introduced through the inlet (40). Additionally, an outlet for gaseous decomposition products, such as hydrogen, (not shown) may also be provided in the cathode compartment. Moreover, the positions of the various inlets and outlets may be changed, depending upon the particular mode of operation which is desired.

Figure 2:
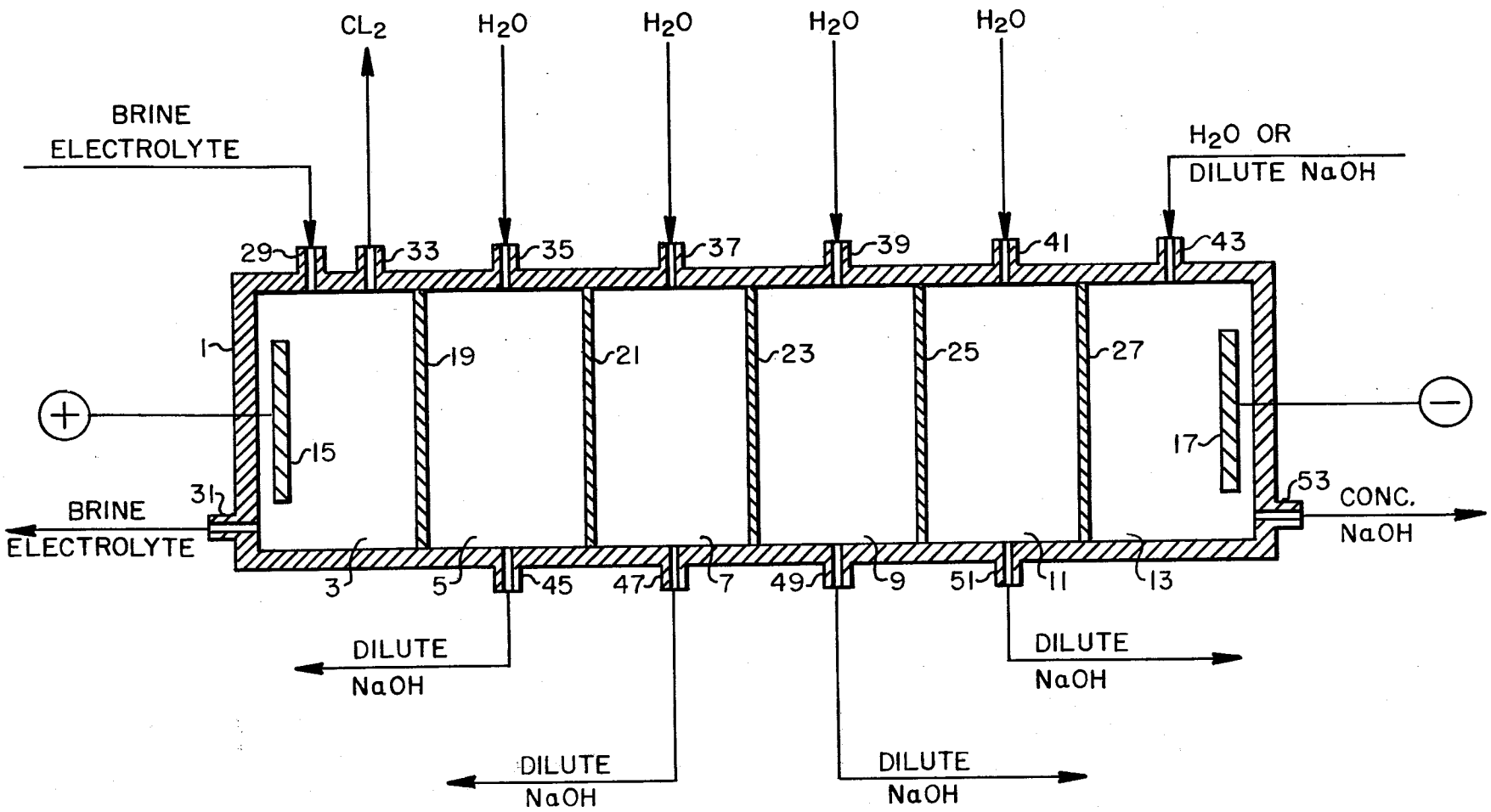
FIG. 2 is a schematic representation of a modification of the electrolytic cell shown in FIG. 1.

Referring now to FIG. 2, this is a schematic representation of a modification of the cell shown in FIG. 1, in which the cell is provided with four buffer compartments between the anode and cathode compartments. As is shown in this Figure, the cell body (1) is formed into an anode compartment (3) and a cathode compartment (13). These compartments are separated by four buffer compartments (5), (7), (9) and (11). An anode (15) and a cathode (17) are positioned in the anode compartment (3) and the cathode compartment (13), respectively. A series of membrane or diaphragm barriers (19), (21), (23), (25) and (27) form the buffer compartments and separate them from the anode compartment and the cathode compartment. The barriers (19), (21) and (23) are membranes formed of a film of a fluorinated copolymer having pendant sulfonic acid groups, as has been described hereinabove, while the barriers (25) and (27) are porous asbestos diaphragms.

An inlet (29) and an outlet (31) are provided in the anode compartment for the introduction and removal of the electrolyte, such as a sodium chloride brine. Additionally, an outlet (33) is also provided in the anode compartment for the removal of gaseous decomposition products, such as chlorine. The buffer compartments (5), (7) (9) and (11) are each provided with inlets (35), (37), (39) and (41), respectively, and outlets (45), (47), (49) and (51), respectively. Where the cell is utilized for the electrolysis of a sodium chloride brine, typically water will be introduced into the inlets and a dilute solution of caustic soda will be removed from the outlets. Additionally, an inlet (43) and an outlet (53) are provided in the cathode compartment (13). Where a sodium chloride brine is being electrolyzed, a concentrated solution of caustic soda of high purity will be recovered from the outlet (53) and water or a dilute caustic soda solution may be introduced through the inlet (43). As with the cell shown in FIG. 1, an outlet for gaseous decomposition products, such as hydrogen, (not shown) may also be provided in the cathode compartment. Additionally, as with the cell configuration shown in FIG. 1, the positions of the various inlets and outlets may be changed, depending upon the particular mode of operation which is desired.

In carrying out the process of the present invention, a solution of the ionizable compound to be electrolyzed is introduced into the anode compartment of the electrolytic cell. Exemplary of the various solutions of ionizable compounds which may be electrolyzed and the products produced are aqueous solutions of alkali metal halides to produce the alkali metal hydroxides and halogen; aqueous solutions of HCl to produce hydrogen and chlorine; aqueous solutions of ammonium sulfate to produce persulfates; aqueous solutions of borax to produce perborates, and the like. Of these, the most preferred anolyte solutions are the aqueous solutions of alkali metal halides, and particularly sodium chloride, and aqueous solutions of HCl.

In a typical process, utilizing a sodium chloride brine as the feed to the anode compartment, the feed solution will contain from about 250 to 325 grams per liter sodium chloride and, most preferably, about 320 grams per liter sodium chloride. The pH of this anolyte feed solution is typically within the range of about 1.0 to 10.0, with a pH of about 3.5 being preferred. These desired pH values in the anode compartment may be maintained by the addition of acid to the anolyte solution, preferably hydrochloric acid. The anolyte overflow or depleted anolyte solution removed from the anode compartment will generally have a sodium chloride content of from about 200 to 295 grams per liter, with a sodium chloride content of about 250 grams per liter being typical.

In one mode of operation, water is introduced into each of the center or buffer compartments and a dilute solution of sodium hydroxide is removed from each of these compartments. Generally, these solutions will vary in concentration, with the most dilute solutions coming from the compartments closest to the anode compartment. Sodium hydroxide contents of from about 50 to 200 grams per liter for these solutions are typical. Preferably, one or more of these dilute solutions of sodium hydroxide are introduced into the cathode compartment, either with or without additional water, to form the catholyte liquor. These solutions may be combined or introduced separately into the cathode compartment. Preferably, however, the dilute sodium hydroxide solutions from each buffer compartment is introduced as at least a portion of the feed to the next succeeding buffer compartment, and ultimately into the cathode compartment. From the cathode compartment there is obtained a more concentrated sodium hydroxide solution having an NaOH concentration of from about 150 to 250 grams per liter, with the sodium hydroxide content of about 160 grams per liter being typical. Additionally, gaseous products of chlorine gas and hydrogen gas are obtained from the anode compartment and the cathode compartment, respectively.

In an alternative method of operation, water is added to both the center or buffer compartments and to the cathode compartment and there is recovered from each of the buffer compartments a product stream of dilute sodium hydroxide and, from the cathode compartment, a product stream of more concentrated sodium hydroxide solution. When operating in this manner, the amount of dilute caustic soda solution recovered from the buffer compartments and the amount of concentrated caustic soda solution recovered from the cathode compartment may be varied, depending upon the particular requirements for each type of solution. In a typical operation, approximately 50% of the sodium hydroxide will be recovered as dilute solutions from the buffer compartments and the amount of concentrated caustic soda solution recovered from the cathode compartment may be varied, depending upon the particular requirements for each type of solution. In a typical operation, approximately 50% of the sodium hydroxide will be recovered as dilute solutions from the buffer compartments with the other 50% being recovered as the more concentrated solution from the cathode compartment. The concentration of these dilute caustic soda solutions will generally be as has been indicated hereinabove. The concentration of the more concentrated caustic solution from the cathode compartment will generally be within the range of about 200 to 420 grams per liter with a concentration of about 280 grams per liter being typical.

The electrochemical decomposition process of the present invention is typically carried out at a voltage within the range of about 3.4 to 4.8 volts, with a voltage of about 4.2 being preferred. Typically, the current densities are within the range of about 0.8 to 2.5 amps per square inch, with current densities of about 2.0 amps per square inch being particularly preferred. In general, the cell will be operated at temperatures within the range of about 90° to 105° centigrade with temperatures of about 95° centigrade being typical. When operating in this manner, it is found that chlorine or anode efficiencies of at least about 96% and cathode or caustic soda efficiencies of at least 85% and frequently in excess of 90% are obtained. Additionally, the concentrated caustic soda solution obtained from the cathode compartment is found to be of high purity, at least approaching, if not equaling, that of "Rayon grade" caustic soda. Typically, the purity of this sodium hydroxide is such that it is substantially free of sodium chlorate and contains less than one gram per liter of sodium chloride.

As has been indicated hereinabove, in addition to the electrolysis of sodium chloride brine solutions, to produce chlorine and caustic soda, in another preferred operation, the electrolytic cells of the present invention may be used for the electrolysis of hydrochloric acid solutions, to form chlorine and hydrogen as the products of the process. In such an operation, the anolyte solution introduced into the anode compartment is an aqueous solution of hydrochloric acid, desirably having an HCl content of from about 10% to 36% by weight and preferably having an HCl content of from about 15 to 25% by weight. Although the feed to the buffer compartments and the cathode compartment may be water alone, in the most preferred method of operation, the feed to both the buffer compartments and the cathode compartment is also an aqueous hydrochloric acid solution. Desirably, the HCl content of these feed solutions is from about 1 to 10% by weight with an HCl content of from about 1 to 5% by weight being preferred. Although it is preferred that the feed solution to the anode, buffer and cathode compartments be substantially free of contaminating ions, in many instances it has been found to be desirable to add alkali metal chlorides, such as sodium chloride to the anolyte, in order to minimize corrosion, particularly where a steel or similar corrodible cathode is used. In these instances, additions of sodium chloride in amounts within the range of about 12 to 25% by weight of the anolyte solution are typical.

In order that those skilled in the art may better understand the present invention and the manner in which it may be practiced, the following speicifc examples are given. In these examples, unless otherwise indicated, temperatures are in degrees centigrade and parts and percent are by weight. It is to be appreciated, however, that these examples are merely exemplary of the method and apparatus of the present invention and are not to be taken as a limitation thereof.

EXAMPLE 1

A four compartment laboratory size electrolytic cell was constructed having an anode compartment and a cathode compartment, separated by two buffer compartments. The anode compartment was formed of a chlorendic acid based polyester, sold under the trademark Hetron®; the two buffer compartments were formed of polypropylene; and the cathode compartment was formed of mild steel. The anode compartment and the first buffer compartment and the first and second buffer compartments were separated from each other by a cation exchange membrane barrier. This membrane was a 10 mil thick film of a hydrolyzed copolymer of tetrafluoroethylene and sulfonated perfluorovinyl ether, having an equivalent weight of about 1100 and prepared according to U.S. Pat. No. 3,282,875. The second buffer compartment and the cathode compartment were separated from each other by conventional asbestos diaphragm. Brine containing about 320 grams/liter NaCl was circulated through the anode compartment, which was equiped with a metallic anode formed of titanium with an $RDO_2$ coating, and water was added to the first buffer compartment. The effluent from the first buffer compartment was pumped into the second buffer compartment and the solution in this compartment flowed through the porous asbestos diaphragm into the cathode compartment, which was equiped with a steel cathode. The cell was operated at 120 amperes, an anode current density of 2.0 amps/square inch and a voltage 4.4 volts. The NaOH concentration of the solution in the first buffer compartment was 120 grams/liter; in the second, 187 grams/liter; and 209 grams/liter in the cathode compartment which latter solution had an NaCl content of about 0.5 grams/liter. When operating under these conditions, the anode chlorine efficiency was 96% and the cathode caustic efficiency was 93%, with hydrochloric acid being added to the anolyte in stoichiometric amounts to compensate for difference between the anode and cathode efficiency.

EXAMPLE 2

Using the procedure as has been described in Example 1, the cell of Example 1 was operated at 120 amperes, an anode current density of 2.0 amps/square inch and a voltage of 4.3 volts. The solution in the first buffer compartment contained 140 grams/liter NaOH; that in the second buffer compartment contained 226 grams/liter; and the effluent from the cathode compartment contained 240 grams/liter NaOH and about 0.6 grams/liter NaCl. The anode chlorine efficiency was 96% and the cathode caustic efficiency was 90%.

EXAMPLE 3

The cell of Example 1 was modified by replacing the asbestos diaphragm between the second buffer compartment and the cathode with a porous perfluorosulfonic acid membrane supplied by duPont and identified as ESL323. Using the procedure of Example 1, this cell was operated with a caustic concentration in the first buffer compartment of 100 grams/liter NaOH; in the second buffer compartment of 140 grams/liter NaOH; and in the cathode compartment effluent of 213 grams/liter NaOH. The anode chlorine efficiency was 96% and the cathode caustic efficiency was 94%.

EXAMPLE 4

The cell of Example 1 was modified by replacing the porous asbestos diaphragm with a porous polypropylene film, identified as Celgard®. Using the procedure of Example 1, this cell was operated under the following conditions and the indicated results were obtained:

| NaOH CONCENTRATION | | | |
|---|---|---|---|
| First Buffer Compartment | Second Buffer Compartment | Cathode Compartment | Cathode Efficiency |
| 110 grams/liter NaOH | 135 grams/liter NaOH | 191 grams/liter NaOH | 93% |
| 125 grams/liter NaOH | 159 grams/liter NaOH | 252 grams/liter NaOH | 92% |
| 135 grams/liter NaOH | 173 grams/liter NaOH | 244 grams/liter NaOH | 91% |
| 150 grams/liter NaOH | 214 grams/liter NaOH | 303 grams/liter NaOH | 89% |

While there have been described various embodiments of the invention, the methods and apparatus described are not intended to be understood as limiting the scope of the invention as changes therewithin are possible and it is intended that each element recited in any of the following claims is to be understood as referring to all equivalent elements for accomplishing substantially the same results in substantially the same or equivalent manner, it being intended to cover the invention broadly in whatever form its principle may be utilized.

What is claimed is:

1. A process for the electrochemical decomposition of an aqueous solution of an ionizable chemical compound selected from the group consisting of alkali metal halides and hydrochloric acid, which process comprises introducing an aqueous solution of said ionizable chemical compound into the anode compartment of an electrolytic cell; wherein said electrolytic cell comprises a cell body having an anode compartment containing an anode, a cathode compartment containing a cathode, and at least two buffer compartments therebetween, said anode compartment being separated from the next adjacent buffer compartment by a barrier which is substantially impervious to fluids and gases, said barriers being a membrane selected from the group consisting of a hydrolyzed copolymer of a perfluorinated hyrocarbon and a sulfonated perfluorovinyl ether, and a sulfostyrenated perfluorinated ethylene propylene polymer, said cathode compartment being separated from the next adjacent buffer compartment by a porous diaphragm; introducing a second aqueous solution into said buffer and cathode compartments, and effecting the electrolytic decomposition of said ionizable solution by passing an electric current between the anode and cathode of said cell.

2. The process as claimed in claim 1 wherein the aqueous solution of an ionizable chemical compound is an aqueous solution of an alkali metal halide and the second aqueous solution introduced into the buffer and cathode compartments is water.

3. The process as claimed in claim 2 wherein the alkali metal halide is sodium chloride and wherein chlorine is produced as the electrolytic decomposition product at the anode, a dilute solution of sodium hydroxide is produced in the buffer compartments and a concentrated solution of sodium hydroxide is produced as an electrolytic decomposition product at the cathode.

4. The process as claimed in claim 3 wherein at least a portion of the dilute solution of sodium hydroxide from each buffer compartment is introduced into the next succeeding buffer compartment and ultimately into the cathode compartment as at least a portion of the aqueous catholyte solution.

5. The process as claimed in claim 4 wherein the aqueous sodium chloride solution introduced into the anode compartment has a pH of from about 1.0 to 10.0 and contains from about 250 to 325 grams per liter NaCl, the cell is operated at a voltage within the range of about 3.4 to 4.8 volts and an anode current density within the range of about 0.8 to 2.5 amps per square inch and the concentration of the sodium hydroxide solution product obtained from the cathode compartment is within the range of about 150 to 250 grams per liter.

6. The process compartment as claimed in claim 4 wherein the porous diaphragm in the electrolytic cell in which the electrolysis is effected is asbestos.

7. The process as claimed in claim 3 wherein the aqueous sodium chloride solution introduced in the anode compartment contains from about 250 to 325 grams per liter NaCl and has a pH within the range of about 1.0 to 10.0, the cell is operated at a voltage within the range of about 3.4 to 4.8 volts and an anode current density within the range of about 0.8 to 2.5 amps per square inch, the concentration of the sodium hydroxide solutions obtained from the buffer compartments is within the range of about 50 to 200 grams per liter of NaOH and the concentration of the sodium hydroxide solution product obtained from the cathode compartment is within the range of about 200 to 420 grams per liter.

8. The process as claimed in claim 3 wherein the porous diaphragm in the electrolytic cell in which the electrolysis is carried out is asbestos.

9. The process as claimed in claim 1 wherein the aqueous solution of an ionizable chemical is an aqueous solution of HCl, chlorine is produced as the electrolytic decomposition product at the anode and hydrogen is produced as the electrolytic decomposition product at the cathode.

10. The process as claimed in claim 9 wherein the aqueous HCl solution introduced into the anode compartment contains from about 10 to 36 percent by weight HCl and the cell is operated at a voltage within the range of about 3.4 to 4.8 volts and an anode current density within the range of about 0.8 to 2.5 amps per square inch.

11. The process as claimed in claim 9 wherein the porous diaphragm in the electrolytic cell in which the electrolysis is effected is asbestos.

12. The process as claimed in claim 1 wherein the porous diaphragm in the electrolytic cell in which the electrolysis is carried out is asbestos.

13. The process as claimed in claim 1, wherein said buffer compartments are separated from each other by a barrier selected from the group consisting of substantially impervious membranes and porous diaphragms, wherein the number of porous diaphragms is equal to or less than the number of substantially impervious membranes, and said porous diaphragms are positioned closest to said cathode compartment.

* * * * *